US007565855B2

(12) United States Patent
Malke et al.

(10) Patent No.: US 7,565,855 B2
(45) Date of Patent: Jul. 28, 2009

(54) SALES SLIP PRINTER WITH A TRAY ARRANGEMENT FOR CONTINUOUS PAPER SEGMENTS

(75) Inventors: Wolfgang Malke, Berlin (DE); Andreas Jeschke, Dallgow (DE); Wilfried Dobring, Berlin (DE)

(73) Assignee: Wincor Nixdorf International GmbH (DE)

( * ) Notice: Subject to any disclaimer, the term of this patent is extended or adjusted under 35 U.S.C. 154(b) by 281 days.

(21) Appl. No.: 11/605,511

(22) Filed: Nov. 28, 2006

(65) Prior Publication Data

US 2007/0131072 A1 Jun. 14, 2007

(30) Foreign Application Priority Data

Dec. 8, 2005 (DE) ..... 10 2005 059 046

(51) Int. Cl.
*B26D 7/32* (2006.01)

(52) U.S. Cl. ..... 83/86; 83/149; 83/79; 83/135; 83/166

(58) Field of Classification Search ..... 83/79, 83/81, 84, 86, 135, 150, 149, 166; 270/30.08
See application file for complete search history.

(56) References Cited

U.S. PATENT DOCUMENTS

| | | | | | |
|---|---|---|---|---|---|
| 76,209 | A | * | 3/1868 | Laughlin | 241/270 |
| 332,666 | A | * | 12/1885 | Laney | 83/165 |
| 576,124 | A | * | 2/1897 | Hume | 83/82 |
| 980,478 | A | * | 1/1911 | Bigazzi et al. | 83/125 |
| 1,429,310 | A | * | 9/1922 | Winkley | 83/112 |
| 1,435,062 | A | * | 11/1922 | Helsel | 83/79 |
| 1,546,918 | A | * | 7/1925 | Clarke | 83/245 |
| 1,882,403 | A | * | 10/1932 | Maxson | 83/150 |
| 1,933,465 | A | * | 10/1933 | Woodburn | 83/135 |
| 3,125,918 | A | * | 3/1964 | Small | 83/150 |
| 3,205,739 | A | * | 9/1965 | Meyer-Jagenberg | 83/23 |
| 3,209,629 | A | * | 10/1965 | Spivey | 83/79 |
| 3,223,059 | A | * | 12/1965 | Jacobs | 112/470.05 |
| 3,854,357 | A | * | 12/1974 | Kron | 83/105 |
| 4,543,864 | A | * | 10/1985 | Hochanadel et al. | 83/91 |
| 4,651,609 | A | * | 3/1987 | Dobring et al. | 83/620 |
| 4,671,151 | A | * | 6/1987 | Rooney | 83/150 |
| 4,791,845 | A | * | 12/1988 | Wright | 83/150 |
| 5,156,075 | A | * | 10/1992 | Campbell et al. | 83/100 |
| 5,179,884 | A | * | 1/1993 | Kutschker et al. | 83/156 |
| RE34,645 | E | * | 6/1994 | Rooney | 83/150 |

(Continued)

FOREIGN PATENT DOCUMENTS

| | | |
|---|---|---|
| DE | 25 21 574 | 5/1975 |

(Continued)

*Primary Examiner*—Kenneth E. Peterson
*Assistant Examiner*—Sean Michalski
(74) *Attorney, Agent, or Firm*—Harness, Dickey & Pierce, P.L.C.

(57) ABSTRACT

A sales slip printer for segments (26) that are to be separated from a continuous paper strip (14) with a V-shaped knife (18) and a stacking tray (24) for the segments (26) separated from the continuous paper strip (14) located behind an output channel (12), which is separated from the output channel (12) by projections (28) extending in the side edge areas of the output channel (12), and a slide (30), which pushes through the already separated edges of the continuous paper strip (14) into the stacking tray (24) between the projections (28) during a cutting action.

12 Claims, 2 Drawing Sheets

U.S. PATENT DOCUMENTS 5,363,728 A * 11/1994 Elsner et al. ..... 83/23
5,732,609 A * 3/1998 Marschke ..... 83/92.1
5,970,833 A * 10/1999 Molison ..... 83/84
6,659,442 B1 * 12/2003 Steinborn et al. ..... 270/52.09
6,968,763 B2 * 11/2005 Chapin et al. ..... 83/164

FOREIGN PATENT DOCUMENTS

DE 29 34 197 C2 8/1979
DE 34 45 744 C1 12/1984
EP 0 027 859 8/1980
EP 0 027 859 * 5/1983
JP 2003127483 A 5/2003

* cited by examiner

SALES SLIP PRINTER WITH A TRAY ARRANGEMENT FOR CONTINUOUS PAPER SEGMENTS

BACKGROUND OF THE INVENTION

1. Technical Field

The invention relates to a sales slip printer with a stacking device for segments separated from a continuous paper strip.

2. Discussion

Printers with a cutting apparatus and an output channel for segments separated from a continuous paper are already known, wherein the cutting apparatus initially cuts and then abscises the continuous paper from the side edges, whereby a movable knife that is perpendicular to the surface of the continuous paper strip and having a V-formed blade is provided on the one side of the continuous paper strip and an opposing blade edge on the other side of the continuous paper strip.

These printers have the problem that a separated segment remains in the output channel after the cutting action, which is pushed out of the output channel by a subsequent segment and falls to the floor.

In DE 34 45 744 C1 it has therefore been described to not completely cut through a paper strip, so that the individual segments are held together through a web. In this manner, unaesthetic paper streamers accrue on the work space. Incidentally, the provision of a movable knife that is perpendicular to the surface of the continuous paper strip and with a V-formed blade on the one side of the continuous paper strip and the provision of an opposing blade edge on the other side of the continuous paper strip is known from DE 34 45 744 C1.

SUMMARY OF THE INVENTION

It is the object of the invention to improve a printer of the described type, such that individual segments of the continuous paper are fed out of the output channel and are stacked in the sequence of their emergence.

In accordance with the invention, a stacking tray located behind the output channel gathers the segments separated from the continuous paper strip, such that the latter in the sequence of their emergence are gathered. For this purpose, the stacking tray is separated by extending projections in the side edge areas of the output channel. Furthermore, a slide is provided, which pushes through the already separated edges of the continuous paper strip between the projections into the stacking tray during a cutting action and thereby enable a stack of the segments.

In accordance with a preferred embodiment of the invention, the slide is moved concurrently with the knife, wherein the slide has a larger gap to the continuous paper strip than the knife at the beginning of the cutting action and overtakes this with progressive feeding of the knife. In this manner it is achieved that the edges of the continuous paper strip are already incised when the slide engages the continuous paper strip. With further feeding of the knife and the slide, the continuous paper strip is further cut into its center. Concurrently, the slide pushes through the already separated edges of the continuous paper strip between the projections until they arrive behind the projections. Through this, a deviation of the continuous paper strip is inhibited and it can be deposited standing upright in the stacking tray. As soon as the continuous paper strip is completely cut through, the segment arrives in the stacking tray. Subsequent segments proceed in the same manner, such that a subsequent segment is deposited behind the first segment.

Commensurate with a preferred further embodiment of the invention, the knife and the slide are moved using a common drive. Preferably, the slide is thereby coupled with the knife by a translation drive.

Preferably, the translation drive is realized through a pivotable lever, to which the knife and the slide are jointed, wherein the length of a first lever arm associated with the slide is larger than the length of a second lever arm associated with the knife. With pivoting of the lever, the slide travels along a larger path than the knife. The lever design is particularly simple and thereby inexpensive to construct.

BRIEF DESCRIPTION OF THE DRAWINGS

Further features and advantages of the invention arise from the following description, which describes an exemplary embodiment of the invention in conjunction with the attached figures. It is shown in.

DESCRIPTION OF THE PREFERRED EMBODIMENTS

Figure 1:
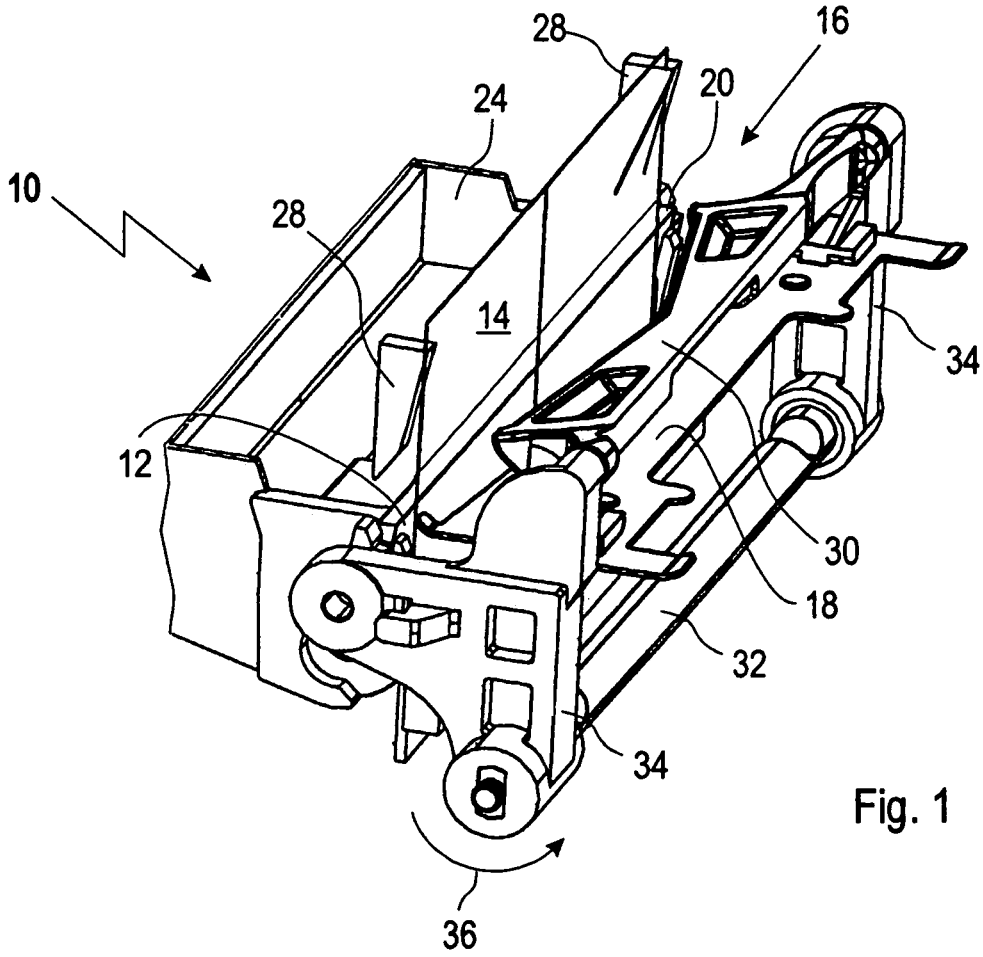
FIG. 1 is a perspective side view of the basic components of a printer in accordance with the invention.

In FIG. 1 the basic components of a printer 10 in accordance with the invention are illustrated in a perspective side view. An output channel 12 leads upward from a printer station, not shown in FIG. 1, which is located underneath the illustrated components. A continuous paper strip 14 lies in the output channel 12. A cutting apparatus 16 is located in the output channel 12. This includes a movable knife 18 that is perpendicular to the surface of the continuous paper strip 14 and that includes a V-formed blade, which is known from DE 34 45 744 C1, on the front side of the continuous paper strip 14 and a cutting beam 20 with an opposing cutting edge 22 (FIG. 3) on the other side of the continuous paper strip 14.

Behind the output channel 12 is located a stacking tray 24 for the sections 26 (FIG. 4) separated from the continuous paper strip 14, and which is separated from the output channel 12 by extending projections 28 in the side edge area of the output channel 12. Above the knife and parallel thereto is located a slide 30, which is shoe-formed in at least the side cross-section and which has a V-form corresponding to the knife 18.

A shaft 32 is rotatably supported on the printer 10 below the knife 18 and parallel thereto. A lever is rotatably fixed to the shaft 32 at both sides of the printer 10. The knife 18 and the slide 30 are jointed to these, wherein the length of a first lever arm 38 associated with the slide 30 is larger than the length of a second lever arm 40 associated with the knife 18.

Figure 2:
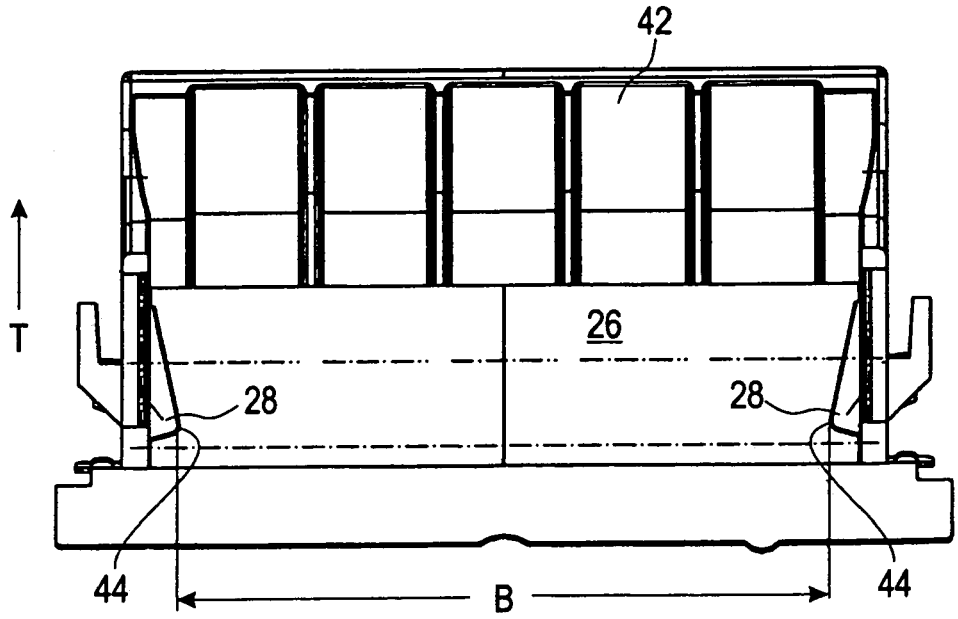
FIG. 2 is a front view of the printer of FIG. 1.

FIG. 2 shows the printer 10 in a front view. A back wall 42 of the stacking tray 24 is recognizable behind the section 26. The bottom ends 44 of the projections 28 extend into the output channel 12, such that its clearance width B in the area of the projections 28 is smaller than the width of the section 26. The gap between the projections 28 widen in a transport apparatus T of the section 26 until achieving the width of the stacking tray 24.

Figure 3:
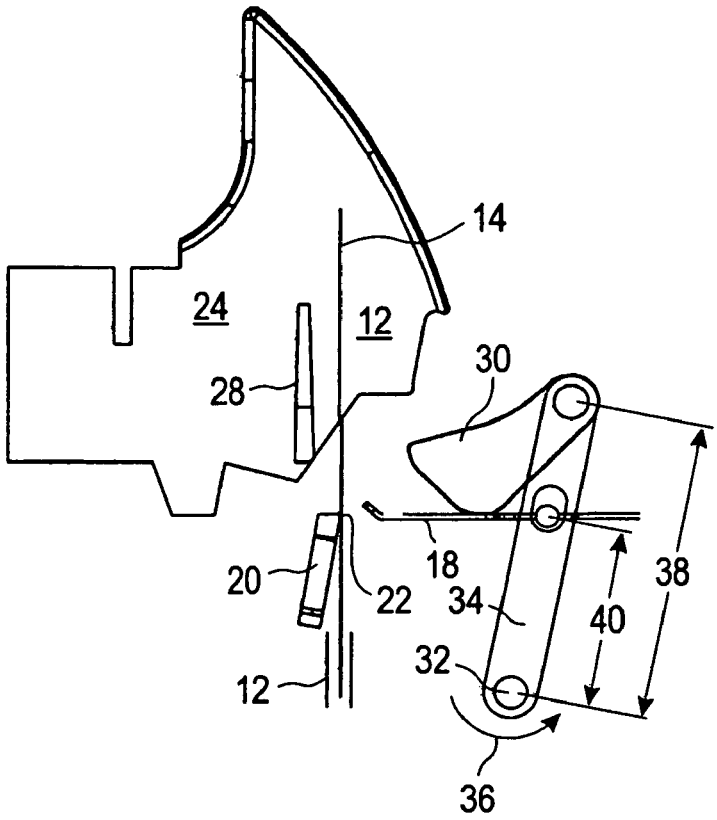
FIG. 3 is a schematic side view, the knife and the slide of the printer of FIG. 1 in their rest position.

The function of the stacking apparatus will be explained in the following in hand with FIGS. 3 and 4, wherein FIG. 3 shows the knife 18 and the slide 30 in their rest position and FIG. 4 in their actuated end position.

In the rest position of the knife 18 and the slide 30 (FIG. 3), the continuous paper strip 14 is located in the output channel 12 and in front of the stacking tray 24. In this position, the slide 30 has a larger gap to the continuous paper strip 14 than the knife 18. The shaft 32 is rotated in the direction of the arrow 36 for cutting of a section from the continuous paper strip 14, whereby the lever 34 pivots in the direction of the stacking tray 24. Through further pivoting of the lever 34, initially the side areas of the knife 18 come into contact with the continuous paper strip 14 and these begin to cut.

When the side incisions are so deep that the uncut part of the continuous paper strip 14 has at most the width of the clearance width B between the projections 28, the slide 30 comes into contact with the continuous paper strip 14 and pushes this through between the projections. The already cut areas of the continuous paper strip are initially held back by the projections 28 and are bent against the feed direction of the slide 30. With further feeding of the knife 18 and the slide 30, the already cut areas of the continuous strip 14 spring through between the projections 28 and again stretch as a result of the of the elasticity of the paper.

Figure 4:
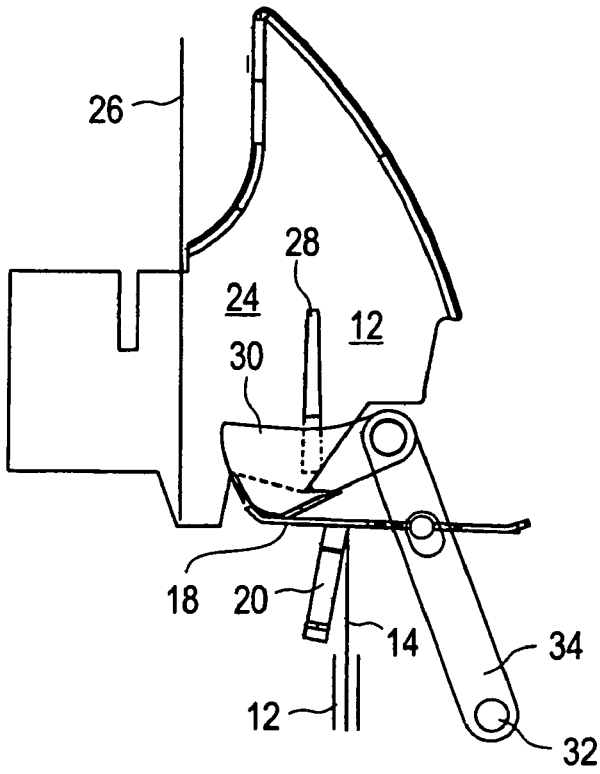
FIG. 4 is a schematic side view, the knife and the slide of the printer of FIG. 1 in their actuated end position.

Also when the continuous paper strip 14 is completely cut through, the pivoting movement of the lever 34 is still continued about a couple of angular degrees until the slide 30 reaches the end position illustrated in FIG. 4. In this manner, the section 26 is pushed against the back wall 42 of the stacking tray 24. Should further sections 26 be separated from the continuous paper strip 14, these are deposited on top of the previous section. The first section can not be pushed out of the stacking tray 24, because the second section does not come into contact with the first deposited continuous paper section during the feeding of the second continuous paper section 26. The sections 26 are stacked in the stacking tray one after the other.

What is claimed is:

1. A sales slip printer with a cutting apparatus (16) and an output channel (12) with an upper portion for segments (26) separated from a continuous paper strip (14), wherein the cutting apparatus (16) initially cuts and then abscises the continuous paper from the side edges, whereby a movable knife that is perpendicular to the surface of the continuous paper strip and with a V-formed blade is provided on the one side of the continuous paper strip and an opposing blade edge on the other side of the continuous paper strip, said printer comprising:

a stacking tray (24) located behind the upper portion of the output channel (12) for receiving the segments (26) separated from the continuous paper strip (14), the stacking tray being separated from the output channel the upper portion of the output channel (12) by projections (28) extending a short distance inwardly from side edge areas of the output channel (12), and a slide (30) reciprocating with said V-formed blade for pushing and flexing the segments between and past the opposed projections and into the tray such that the segments will not return to the cutting apparatus.

2. A sales slip printer in accordance with claim 1, characterized in that the slide (30) is concurrently movable with the knife (18), wherein it has a larger gap to the continuous paper strip (14) than the knife (18) at the beginning of the cutting action and overtakes this with progressive feeding of the knife (18).

3. A sales slip printer in accordance with claim 1, characterized in that the slide (30) conforms to the V-form of the blade.

4. A sales slip printer in accordance with claim 1, characterized in that the knife (18) and the slide (30) are commonly drivable.

5. A sales slip printer in accordance with claim 4, characterized in that the slide (30) is coupled with the knife (18) by a translation drive.

6. A sales slip in accordance with claim 5, characterized in that the knife (18) and the slide (30) are jointed to a pivotable lever (34), wherein the length of a first lever arm (38) associated with the slide (30) is larger than the length of a second lever arm (40) associated with the knife (18).

7. A sales slip printer comprising:

a cutting apparatus and an upper portion of an output channel for segments separated from a continuous paper strip wherein the cutting apparatus initially cuts and then abscises the continuous paper from the side edges, a movable knife that is perpendicular to the surface of the continuous paper strip, said knife having a blade provided on the one side of the continuous paper strip and an opposing blade edge on the other side of the continuous paper strip, a stacking tray located behind the output channel for receiving the segments separated from the continuous paper strip, projections located between the output channel and the stacking tray, said projections extending a short distance inwardly sufficiently to contact side edges of the segments as they travel from the output channel to the stacking tray; and a slide reciprocating with said blade for pushing and flexing segments through the projections into the tray such that the segments will not return to the cutting apparatus during a cutting action of the blade.

8. A sales slip printer in accordance with claim 7 wherein the slide is concurrently movable with the knife wherein it has a larger gap to the continuous paper strip than the knife at the beginning of the cutting action and overtakes this with progressive feeding of the knife.

9. A sales slip printer in accordance with claim 7 wherein the slide conforms to the V-form of the blade.

10. A sales slip printer in accordance with claim 7 wherein the knife and the slide are driven in common.

11. A sales slip printer in accordance with claim 10 wherein the slide is coupled with the knife by a translation drive.

12. A sales slip in accordance with claim 11 wherein the knife and the slide are jointed to a pivotable lever, wherein the length of a first lever arm associated with the slide is larger than the length of a second lever arm associated with the knife.

* * * * *